US011162277B2

(12) United States Patent
Spath

(10) Patent No.: US 11,162,277 B2
(45) Date of Patent: Nov. 2, 2021

(54) TEMPORAL LOCK SYSTEM

(71) Applicant: Carrier Corporation, Jupiter, FL (US)

(72) Inventor: Tony Spath, West Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/628,506

(22) PCT Filed: Jul. 5, 2018

(86) PCT No.: PCT/US2018/040858
§ 371 (c)(1),
(2) Date: Jan. 3, 2020

(87) PCT Pub. No.: WO2019/010264
PCT Pub. Date: Jan. 10, 2019

(65) Prior Publication Data

US 2020/0157844 A1 May 21, 2020

Related U.S. Application Data

(60) Provisional application No. 62/528,665, filed on Jul. 5, 2017.

(51) Int. Cl.
*E05B 19/00* (2006.01)
*G07C 9/00* (2020.01)

(52) U.S. Cl.
CPC ..... *E05B 19/0005* (2013.01); *G07C 9/00309* (2013.01); *G07C 9/00571* (2013.01); *G07C 9/00904* (2013.01); *G07C 2009/00936* (2013.01); *G07C 2209/08* (2013.01)

(58) Field of Classification Search
None
See application file for complete search history.

(56) References Cited

U.S. PATENT DOCUMENTS

| | | | | |
|---|---|---|---|---|
| 5,051,724 | A | 9/1991 | Morrow et al. | |
| 8,410,901 | B2 | 4/2013 | Mullin et al. | |
| 8,633,799 | B1 | 1/2014 | Aronson et al. | |
| 8,768,565 | B2 * | 7/2014 | Jefferies | G07C 9/00571 701/32.7 |
| 9,367,217 | B2 | 6/2016 | Moore, Jr. | |

(Continued)

FOREIGN PATENT DOCUMENTS

| | | | |
|---|---|---|---|
| CN | 104869145 | A | 8/2015 |
| KR | 20120108199 | A | 10/2012 |
| WO | 2016089846 | A1 | 6/2016 |

OTHER PUBLICATIONS

"App lets you rent a toel room by the hour—no questions asked" by James Covert dated Jun. 3, 2016; 2 pages.

(Continued)

*Primary Examiner* — Carlos Garcia
(74) *Attorney, Agent, or Firm* — Cantor Colburn LLP

(57) ABSTRACT

A temporal lock system adapted to controllably dispense a key for unlocking a lock and upon a request from a mobile device. The temporal lock system includes a timer, a lock assembly, and a mobile device application. The lock assembly is adapted to dispense the key and initiate the timer upon dispensing of the key. The mobile device application is configured to output a retrieve key signal to the lock assembly for dispensing of the key.

18 Claims, 2 Drawing Sheets

(56) References Cited

U.S. PATENT DOCUMENTS

| | | | | |
|---|---|---|---|---|
| 9,437,063 | B2 | 9/2016 | Schoenfelder et al. | |
| 9,614,844 | B2 | 4/2017 | Turner et al. | |
| 2003/0158761 | A1* | 8/2003 | Johnston | G06Q 30/0645 705/5 |
| 2008/0012684 | A1* | 1/2008 | Fawcett | G07C 9/00309 340/5.25 |
| 2011/0313798 | A1 | 12/2011 | Furlong et al. | |
| 2014/0279713 | A1 | 9/2014 | Calman et al. | |
| 2015/0145647 | A1* | 5/2015 | Engel-Dahan | G07C 9/28 340/5.61 |
| 2015/0254760 | A1 | 9/2015 | Pepper | |
| 2016/0063617 | A1 | 3/2016 | Alhakim | |
| 2016/0163138 | A1 | 6/2016 | Turner et al. | |
| 2016/0180621 | A1 | 6/2016 | Desinor, Jr. | |
| 2016/0364928 | A1 | 12/2016 | Woodard et al. | |
| 2017/0132862 | A1 | 5/2017 | Monette et al. | |
| 2017/0301199 | A1* | 10/2017 | Blaser | H04B 1/3877 |
| 2019/0139337 | A1* | 5/2019 | Briskey | G07C 9/215 |

OTHER PUBLICATIONS

"Recharge—Luxury Hotels Unlocked" by Recharge Labs; 2 pages.
"Remotely Control Access to Your Rental Properties" Technologies Ltd.; 3 pages.
"Renting Your Home Out, By the Hour" By Ronda Kaysen dated Mar. 10, 2017; 4 pages.
Search Report for Application No. PCT/US2018/040858 dated Sep. 18, 2018; 6 pages.
Written Opinion for Application No. PCT/US2018/040858 dated Sep. 18, 2018; 12 pages.

* cited by examiner

TEMPORAL LOCK SYSTEM

CROSS-REFERENCE TO RELATED APPLICATIONS

This is a National Stage Application of PCT/US2018/040858 filed Jul. 5, 2018, which claims priority to U.S. Provisional Application No. 62/528,665 filed Jul. 5, 2017, both of which are incorporated herein by reference in their entirety.

BACKGROUND

The present disclosure relates to a temporal lock system, and more particularly, to a temporal lock system operated by a mobile device.

Traditionally, lock boxes and similar devices are operated manually by a user to gain access to a key that unlocks an independent lock. Such lock boxes require the user to know a combination to gain access to the key. Unfortunately, such lock box use creates a cumbersome process and often scenarios where security may be in question.

BRIEF DESCRIPTION

A temporal lock system adapted to controllably dispense a key for unlocking a lock and upon a request from a mobile device according to one, non-limiting, embodiment of the present disclosure includes a timer; a lock assembly constructed and arranged to dispense the key and initiate the timer upon dispensing of the key; and a mobile device application programmed into the mobile device and configured to output a retrieve key signal to the lock assembly for dispensing of the key.

Additionally to the foregoing embodiment, the lock device is attached to an access door.

In the alternative or additionally thereto, in the foregoing embodiment, the access door is constructed and arranged to provide access to a hotel room.

In the alternative or additionally thereto, in the foregoing embodiment, the lock assembly includes a key repository and a processor configured to receive the retrieve key signal, validate the retrieve key signal, and unlock the key repository upon validation of the retrieve key signal.

In the alternative or additionally thereto, in the foregoing embodiment, the temporal lock system includes a server configured to receive a request signal from the mobile device, process the request signal, and output a server signal including validation information received by the lock assembly.

In the alternative or additionally thereto, in the foregoing embodiment, the server signal is sent to the lock assembly via the mobile device.

In the alternative or additionally thereto, in the foregoing embodiment, the timer is part of the server.

In the alternative or additionally thereto, in the foregoing embodiment, return of the key to the lock assembly causes the processor of the lock assembly to terminate the timer.

In the alternative or additionally thereto, in the foregoing embodiment, the lock assembly includes a key presence device adapted to detect the return of the key.

In the alternative or additionally thereto, in the foregoing embodiment, return of the key detected by the key presence device terminates the timer.

In the alternative or additionally thereto, in the foregoing embodiment, communications between the lock assembly and the mobile device is Near Field Communications.

In the alternative or additionally thereto, in the foregoing embodiment, the lock assembly is an off-line lock assembly.

In the alternative or additionally thereto, in the foregoing embodiment, return of the key detected by the key presence device initiates a third party alert.

In the alternative or additionally thereto, in the foregoing embodiment, return of the key to the lock assembly causes the timer to terminate, and a payment module configured to be executed by the server correlates a time duration to payment.

A temporal lock assembly configured to communicate with a mobile device and controllably store a key according to another, non-limiting, embodiment includes a lockable key repository for controlled storage and release of the key; an electronic processor; a receiver configured to receive a retrieve key signal from the mobile device; and an electronic processor configured to process the retrieve key signal and operate the lockable key repository to release the key.

Additionally to the foregoing embodiment, the temporal lock assembly includes an electronic storage medium configured to store validation data, and wherein the electronic processor is configured to apply the validation data to validation information contained in the retrieve key signal to validate the retrieve key signal.

In the alternative or additionally thereto, in the foregoing embodiment, the temporal lock assembly includes a timer configured to initiate upon removal of the key from the lockable key repository and terminate upon return of the key.

In the alternative or additionally thereto, in the foregoing embodiment, the temporal lock assembly includes a key presence device configured to detect the presence of the key in the lockable key repository.

In the alternative or additionally thereto, in the foregoing embodiment, the key presence device is adapted to detect the weight of the key.

In the alternative or additionally thereto, in the foregoing embodiment, the key presence device is adapted to detect a magnetic field.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
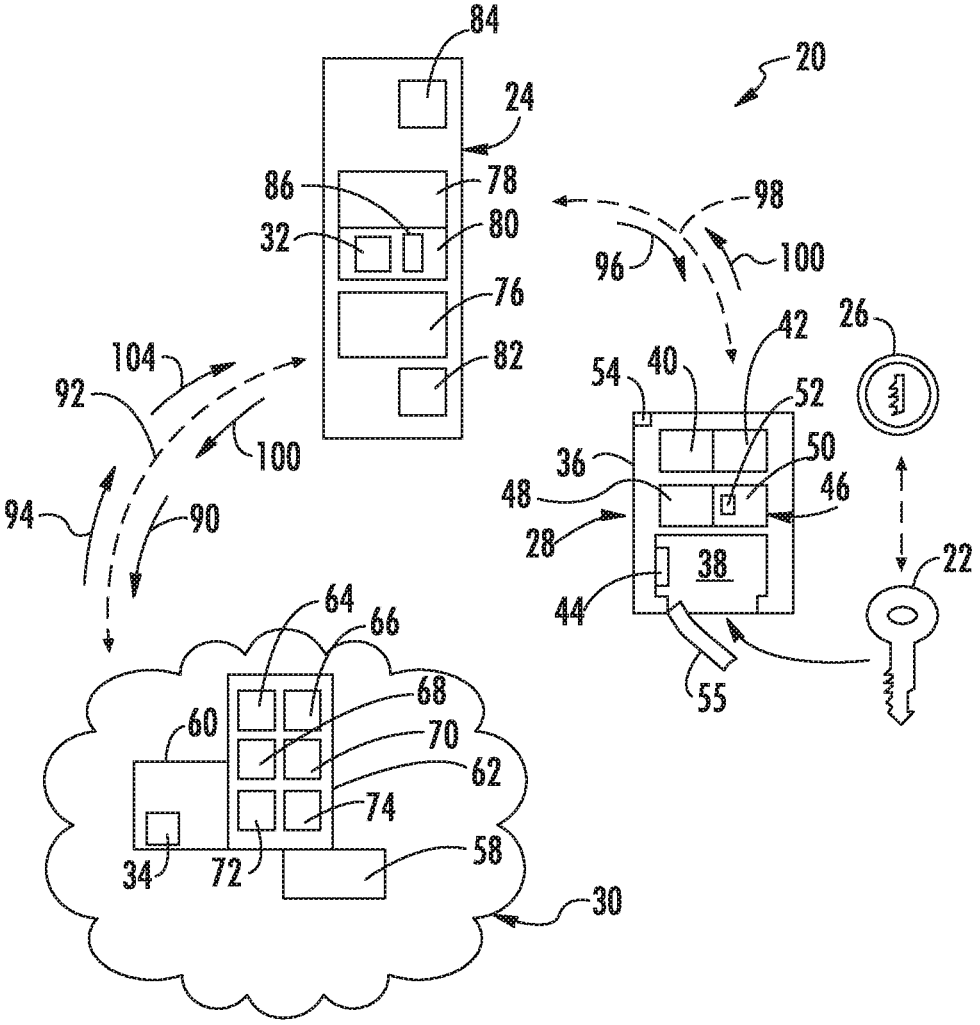
FIG. 1 is a diagram of a temporal lock system as one, non-limiting, exemplary embodiment of the present disclosure.

Referring to FIG. 1, a temporal lock system 20 facilitates the controlled and timed release of a key 22 upon an authenticated request from a mobile device 24 that may be carried by an occupant or user. Once released, the key 22 may be used to unlock a more conventional lock 26 (e.g., deadbolt) that may generally be independent of the temporal lock system 20. In one example, the key 22 may be a small piece of shaped metal with incisions cut to fit the wards of a particular lock 26. In other examples, the key 22 may be a card with a magnetic strip and/or a bar code that is detectable and/or readable by the lock 26, or a digital key. The lock 26 may be part of a storage safe and/or an access door (not shown). The door may be a hotel room door, an entry door of a house or business, or other elements that may require locking. Examples of the mobile device 24 may include a smartphone, a tablet, and other devices typically carried by a user.

The temporal lock system 20 may include at least one lock assembly 28, at least one server 30 that may be remote and/or cloud-based, an application 32 that may be software-based and loadable onto the mobile device 24, and a timer 34 (e.g., payment clock). The lock assembly 28 may include a casing 36, lockable key repository 38, a receiver 40, a transmitter 42, a key presence device 44, and a controller 46. The controller 46 may include a processor 48 (e.g., microprocessor) and an electronic storage medium 50 that may be computer writeable and readable. The storage medium 50 may store any variety of electronic data including maintenance data or logs, and a user validation application or module 52 that may be software-based and executable by the processor 48. It is contemplated and understood that the server 30 may not be remote, and may be a local computer located, for example, in a building containing the lock assembly 28. It is further contemplated that the lock assembly 28 may be self-contained, having the needed processing capability within the lock assembly 28 itself, and communicating solely with the mobile device 24 that may possess the required validation.

Figure 2:
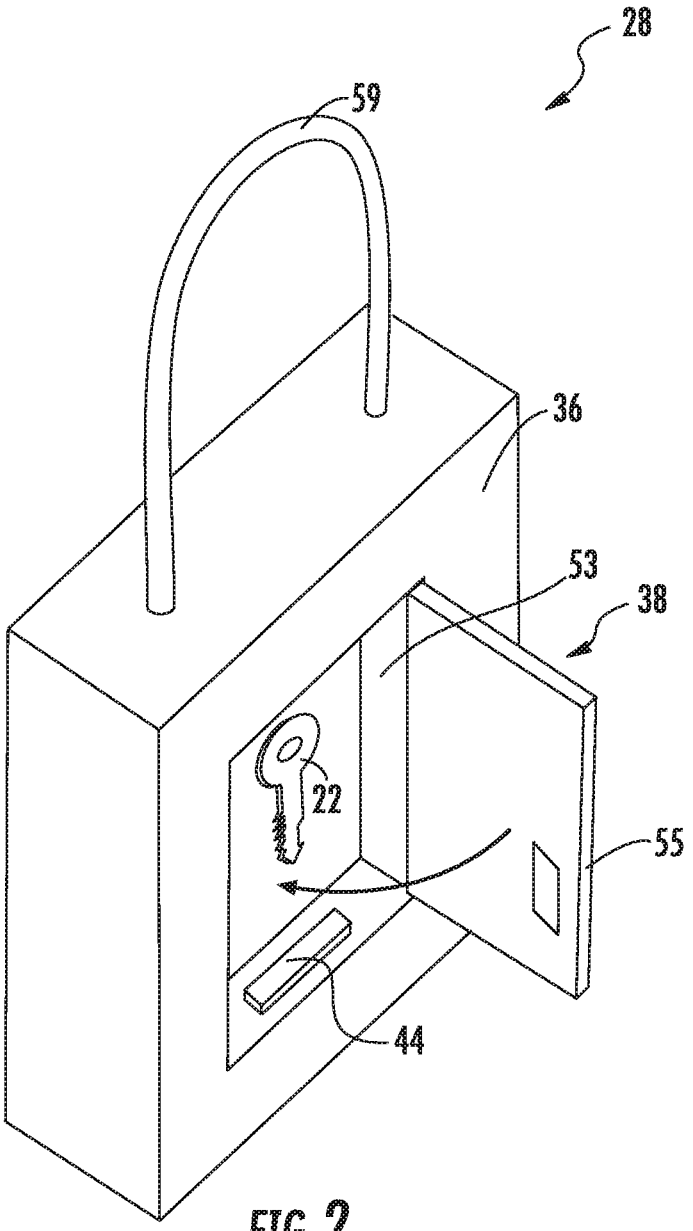
FIG. 2 is a schematic of a locking assembly of the temporal lock system.

Referring to FIGS. 1 and 2, the lockable key repository 38 may generally include a key compartment 53, an access panel 55, a lockable, or releasable latch 57, and a hanger or attachment means 59. The key compartment 53 may include boundaries defined by the casing 36 and the access panel 55. The access panel 55 may be releasably engaged to the casing 36 via the releasable latch 57. The engagement and disengagement of the latch 57 may be generally controlled by the controller 46. For example, when the latch 57 is initially disengaged by the controller 48, and at the request sent from the mobile device 24, the processor 48 of the controller 46 may start the timer 34. Starting of the timer 34 may be indicative of the user of the mobile device 24 removing the key from the key repository 38. Once removed, the processor 48 may, or may not, output a command that re-latches the access panel 55 closed. Upon the return of the key 22 by the user, the key presence device 44 may sense the return of the key 22 resulting in termination of the timer 34 and closure/re-latching of the access panel 55 to secure the key 22. Examples of the releasable latch 57 may include any variety of mechanical and/or magnetic devices generally known by those skilled in the art of latches. Examples of a key presence device 44 may include a device capable of sensing the weight of the key 22, a device capable of sensing a magnetic field indicative of a magnetic strip of the key 22, or other close-range signal emitted from the key.

In one embodiment, the lock assembly 28 may be an off-line lock assembly and all communications between the server 30 and the lock assembly 28 may be conducted through the mobile device 24. The lock assembly 28 may further communicate with the mobile device 24 via the application 32 and by way of Near-Field Communications (NFC) or two-way Bluetooth communications at generally no monthly service cost to the owner(s) of the lock assemblies 28. Instead, long range, wireless, communications may be fielded by the user or owner of the mobile device 24. Alternatively, it is contemplated and understood that communications may be conducted directly between the server 30 and the lock assembly 28. Yet further and in one example, if the server 30 is a local computer, the lock assembly 28 and the local computer 30 may conduct communication between each other via hard wire(s).

In one example, the lock assembly 28 may be one of a plurality of lock assemblies capable of communicating to and/or through the mobile device 24, via the application 52, and to the server 30. Each lock assembly 28 may include an address 54 (e.g., site address) associated with the lock assembly 28 and/or the specific site (i.e., lock 26, hotel room, residential home address, etc.). The address 54 may be displayed visually on the lock assembly 28, or may be transmitted (i.e., a beacon) by the transmitter 42 of the lock assembly 28 for receipt by the mobile device 24.

In one example, the address 54 may be a barcode, QR code, or other code fixed to the lock assembly 28, capable of being scanned, or read, by the mobile device 24. In another example, the address 54 may be wirelessly broadcasted as an advertisement over a relatively short distance (e.g., Bluetooth® advertisement) that may be received and identified by the mobile device 24. In yet a third example, the mobile device 24 may identify a lock assembly 28 based on the geographic location of the assembly preprogrammed into either the server 30 and/or the mobile device 24, and use of a geographic positioning application 56 applied by the mobile device 24.

In one embodiment, the lock 26, the key 22, and the lock assembly 28 may be generally, permanently, associated with the same address 54. In another embodiment, the address 54 of the lock assembly 28 may be temporarily associated with a site of the lock 26 and the key 22 that works with the lock 26. In this example, the server 30, or the controller 46 of the lock assembly 28 may be programmed to at least temporarily associate the address 54 to the site of the lock 26 and the key 22.

The server 30 may include a transceiver 58 for wireless communications, a processor 60 (e.g., microprocessor), and an electronic storage medium 62 that may be computer writeable and readable. In one embodiment, the server 30 may be configured to correlate the address 54 of the lock assembly 28 to a specific site of the lock 26, which temporarily utilizes the lock assembly 28. More specifically, and in one example, the lock assembly 28 may be a realtor lock box that may be temporarily secured to an entry door of a home to be sold. A realtor, or user, may then program the lock assembly 28 by entering the home address into the lock assembly itself or into the server 30. The key 22 is the key typically used by the home owner, and provide access to the home. Although illustrated as part of the server 30, the timer 34 may, alternatively, be part of the controller 46 of the lock assembly 28.

The server storage medium 62 may store any variety of modules that may be software based and executable by the processor 60. For example, the modules may include a credentialing module 64, a payment module 66, a validation module 68, an address correlation module 70, a third party alert, or maintenance, module 72, an occupancy module 74, and other modules. The credentialing module 64 may be configured to determine the credentials, and/or ability to pay, of the user of the mobile device 24. The payment module 66 may generate and electronically collect a bill incurred by the user of the mobile device 24 based on a duration of time measured by the timer 34. The validation module 74 may generally assign a specific lock assembly 28 associated with a specific lock 26 (i.e., associated with a specific hotel room) for a particular mobile device 24. This validation may be associated with any number of factors including occupancy. The address correlation module 70 may be used to correlate the address 54 of the lock assembly 28 to a site of the lock 26 that may be temporarily assigned to the lock assembly 28. That is, the correlation module 70 may apply a programmable, cross-referencing, data table. The maintenance module 72 may generally utilize the timer 34 and/or frequency or number of lock assembly 28 actuations/uses to determine the need for maintenance regarding the site associated with the lock 26 (e.g., cleaning of a hotel room or general property management issues). The occupancy module 74 may apply a real-time update of when a site is being utilized. For example, if a site associated with a lock 26 that is connected to a particular lock assembly 28, is presently being utilized, the occupancy module 68 may aside a different site with a different lock assembly 28 to a requesting user of a mobile device 24. It is contemplated and understood that any number of the modules 64, 66, 68, 70, 72, 74 may be stored and executed by the controller of the lock assembly 28, or as part of the application 32 of the mobile device 24. It is further contemplated that any number of the modules 64, 66, 68, 70, 72, 74, together, may comprise an executable application (i.e., a computer software product).

The mobile device 24 may include a user interface 76, a processor 78 (e.g., microprocessor), an electronic storage medium 80 that may be computer writeable and readable, a scanning device or camera 82, and a transceiver 84. The storage medium 80 may store the application 32 and the processor 78 may execute the application. The application 32 loaded in the mobile device application 32 may be configured to identify the specific lock assembly 28 that may be amongst a plurality of lock assemblies. In one example, the mobile device 24 may be configured to visually read the address 54 as a bar code using the camera 82 of the mobile device 24. In another embodiment, the mobile device 24 may be configured to receive the address 54 as a wireless signal or short range advertisement via the transceiver 84. In yet a third example, the application 32 may apply a geographic positioning module 86 of the mobile device 24, at least in-part stored in the storage medium 80 and executed by the processor 78, to generally determine the location of the desired address.

In the embodiment where the address 54 of the lock assembly 28 is a short range advertisement (e.g., Bluetooth advertisement), the mobile device 24 may be programmed with compatible software (i.e., the application 32). In one example, the lock assembly 28, or controller 46, may include a Bluetooth device capable of transmitting the advertisement 54. The transceiver (i.e., receiver 40 and transmitter 42) may be of a type to support Bluetooth® communications. Further, the address 54 may be advertised with continual advertisements from the lock assembly 28, and may be received by the mobile device 24 without the lock assembly 28 knowing or recognizing that a mobile device 24 is nearby.

In the embodiment that applies the geographic position module 86 of the mobile device 24, the geographic position module 86 may be configured to determine positioning information indicative of a geographical position using one or more positioning systems or protocols of a type well known in the art, such as Global Positioning Systems (GPS), Global Navigation System (GLONASS), Global Navigation Satellite System (GNSS), Galileo, Long Range Navigation (LORAN), National Marine Electronics Association (NMEA), Trimble Standard Interface Protocol (TSIP), DELORME® EARTHMATE®, Rockwell PLGR Protocol, iBeacon®, and SIRF®, to name a few non-limiting examples. It will also be appreciated that the geographic position module 86 may include local, regional, or site-wide systems of a type well known in the art, such as radio frequency identification (RFID), infrared (IR), sensor networks, Wi-Fi-based positioning, and Ultra-Wideband (UWB) positioning systems, to name a few non-limiting examples. The geographic position module 86 may work in conjunction with the application 52 of the lock assembly 28. The geographic position module 86 may be a Global Positioning System (GPS) receiver circuit, or circuitry associated with other satellite navigation systems. In any case, the module 86 and lock assembly application 52 function to determine the position of the mobile device 24 relative to a known placement of the lock assembly 28. It will also be appreciated that the positioning information may include types well known in the arts such as, geographic latitude and longitude, Universal Transverse Mercator (UTM) and Universal Polar Stereographic (UPS) coordinates, stereographic coordinates, geodetic height, Cartesian coordinates, and site address, to name a few non-limiting examples.

Operation of the temporal lock system 20 will now be described using the example application of a hotel, wherein each hotel room access door, or lock 26, may have a respective lock assembly 28. The address correlation module 70 may be used to preprogram each lock assembly 28 to a particular hotel room number (i.e., site). A user of the mobile device 24 may request a hotel room via the application 32. The mobile device 24 may then send a request signal (see arrow 90) over a wireless pathway 92 to the server 30. The server 30 may then apply the credentialing module 64 to make appropriate inquires of the user and confirm the user's credentials and/or ability to pay. Once confirmed, the server 30 may apply the occupancy module 74 to determine and assign an available hotel room. Once assigned, the server 30 may apply the validation module 68 to output a signal (see arrow 94) that contains information to the room assignment established by the occupancy module 74 and validation information that provides the mobile device 24 with the necessary code or permission to communicate with, and operate, the assigned lock assembly.

When the user and mobile device 24 are proximate to the lock assembly 28, the mobile device 24 may output a retrieve key signal (see arrow 96) over a wireless pathway 98 to the lock assembly 28. The retrieve key signal 96 may contain the assigned validation information initially provided by the server 30. The validation application 52 of the lock assembly 28 may validate the user, then unlatch the key repository 38.

The user of the mobile device 24 may then remove the key 22 from the lock assembly 28. Upon removal, or upon unlatching of the key repository 38, the timer 34 may be initiated. If the timer 34 is generally at the server 30, the processor 48 of the lock assembly 28 may send an initiate timer command signal (see arrow 100), through the mobile device 24, and to the server 30.

The user may then apply the key 22 to the lock 26 to unlock the hotel room door. When the user is departing the hotel, the user may then return the key 22 to the key repository 38, wherein the key presence device 44 may detect the return of the key. Upon the key return, the processor 48 of the lock assembly 28 may generate a terminate timer command signal (see arrow 102) that is sent to the server 30 via the mobile device 24. The server 30 may then stop the timer and establish a time duration that the user has generally occupied the hotel room. The time duration may be applied by the payment module to establish an amount of money owed by the user. The resulting bill, confirmation of payment, and/or acknowledgement of the key return may be sent from the server 30 to the mobile device 24 as a signal (see arrow 104) and displayed on the user interface 76. Yet further, the maintenance module 72 may be applied by the server 30 upon user departure to arrange a cleaning of the hotel room.

The various functions described above may be implemented or supported by a computer program that is formed from computer readable program codes, and that is embodied in a computer readable medium. Computer readable program codes may include source codes, object codes, executable codes, and others. Computer readable mediums may be any type of media capable of being accessed by a computer, and may include Read Only Memory (ROM), Random Access Memory (RAM), a hard disk drive, a compact disc (CD), a digital video disc (DVD), or other forms.

Terms used herein such as component, application, module, system, and the like are intended to refer to a computer-related entity, either hardware, a combination of hardware and software, or software execution. By way of example, an application may be, but is not limited to, a process running on a processor, a processor, an object, an executable, a thread of execution, a program, and/or a computer. It is understood that an application running on a server and the server, may be a component. One or more applications may reside within a process and/or thread of execution and an application may be localized on one computer and/or distributed between two or more computers.

Advantages and benefits of the present disclosure include a twenty-four/seven rental capability of, for example, hotel room. This may effectively allow for the value of the real estate to be optimized by increasing the usage levels. Other advantages include the simplified ability to arrange rental periods coordinated with cleaning staff alerts. As markets increasingly embrace the sharing economy (i.e., Airbnb, WeWork, and others), traditional rental periods may need to adapt to an on-demand model. The present disclosure provides a means to facilitate an on-demand rental model.

While the present disclosure is described with reference to illustrated embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A temporal lock system adapted to controllably dispense a key for unlocking a lock and upon a request from a mobile device, the temporal lock system comprising:

a timer;

a lock assembly constructed and arranged to dispense the key and initiate the timer upon dispensing of the key, the lock assembly including a key repository;

a mobile device application programmed into the mobile device and configured to output a retrieve key signal to the lock assembly for dispensing of the key; and at least one processor configured to receive the retrieve key signal, validate the retrieve key signal, and unlock the key repository upon validation of the retrieve signal, and wherein return of the key to the lock assembly causes the processor of the lock assembly to terminate the timer.

2. The temporal lock system set forth in claim 1, wherein the lock assembly is attached to an access door.

3. The temporal lock system set forth in claim 2, wherein the access door is constructed and arranged to provide access to a hotel room.

4. The temporal lock system set forth in claim 1, wherein the lock assembly includes a key presence device adapted to detect the return of the key.

5. The temporal lock system set forth in claim 4, wherein return of the key detected by the key presence device terminates the timer.

6. The temporal lock system set forth in claim 4, wherein return of the key detected by the key presence device initiates a third party alert.

7. The temporal lock system set forth in claim 1, wherein the lock assembly includes a processor of the at least one processor configured to receive the retrieve key signal, validate the retrieve key signal, and unlock the key repository upon validation of the retrieve key signal.

8. The temporal lock system set forth in claim 7, wherein the at least one processor includes a server configured to receive a request signal from the mobile device, process the request signal, and output a server signal including validation information received by the lock assembly.

9. The temporal lock system set forth in claim 8, wherein the server signal is sent to the lock assembly via the mobile device.

10. The temporal lock system set forth in claim 9, wherein communications between the lock assembly and the mobile device is Near Field Communications.

11. The temporal lock system set forth in claim 10, wherein the lock assembly is an off-line lock assembly.

12. The temporal lock system set forth in claim 8, wherein the timer is part of the server.

13. The temporal lock system set forth in claim 8, wherein return of the key to the lock assembly causes the timer to terminate, and a payment module configured to be executed by the server correlates a time duration to payment.

14. A temporal lock assembly configured to communicate with a mobile device and controllably store a key, the temporal lock assembly comprising:

a lockable key repository for controlled storage and release of the key;

a receiver configured to receive a retrieve key signal from the mobile device;

an electronic processor configured to process the retrieve key signal and operate the lockable key repository to release the key; and a timer configured to initiate upon removal of the key from the lockable key repository and terminate upon return of the key.

15. The temporal lock assembly set forth in claim 14, further comprising:

an electronic storage medium configured to store validation data, and wherein the electronic processor is configured to apply the validation data to validation information contained in the retrieve key signal to validate the retrieve key signal.

16. The temporal lock assembly set forth in claim 14, further comprising:

a key presence device configured to detect the presence of the key in the lockable key repository.

17. The temporal lock assembly set forth in claim 16, wherein the key presence device is adapted to detect the weight of the key.

18. The temporal lock assembly set forth in claim 16, wherein the key presence device is adapted to detect a magnetic field.

* * * * *